US010577826B2

(12) United States Patent
Lohnes

(10) Patent No.: US 10,577,826 B2
(45) Date of Patent: Mar. 3, 2020

(54) OUTDOOR LATTICE SYSTEM

(71) Applicant: Ecolattice Com LLC, Farmingdale, NJ (US)

(72) Inventor: Michael Lohnes, Manasquan, NJ (US)

(73) Assignee: ECOLATTICE COM LLC, Farmingdale, NJ (US)

( * ) Notice: Subject to any disclaimer, the term of this patent is extended or adjusted under 35 U.S.C. 154(b) by 0 days.

(21) Appl. No.: 16/175,158

(22) Filed: Oct. 30, 2018

(65) Prior Publication Data

US 2019/0128015 A1 May 2, 2019

Related U.S. Application Data

(60) Provisional application No. 62/578,584, filed on Oct. 30, 2017.

(51) Int. Cl.

| | |
|---|---|
| ***E04H 17/16*** | (2006.01) |
| ***A47B 47/04*** | (2006.01) |
| ***A47B 47/00*** | (2006.01) |
| ***E04H 17/18*** | (2006.01) |
| ***A47F 5/10*** | (2006.01) |

(52) U.S. Cl.

CPC ..... *E04H 17/168* (2013.01); *A47B 47/0091* (2013.01); *A47B 47/047* (2013.01); *A47F 5/103* (2013.01); *E04H 17/16* (2013.01); *E04H 17/18* (2013.01); *A47B 2200/12* (2013.01); *A47B 2220/008* (2013.01); *A47B 2220/0052* (2013.01); *A47B 2230/0092* (2013.01)

(58) Field of Classification Search

CPC ..... E04H 17/168; E04H 17/16; E04H 17/18; A47B 47/0091; A47B 47/047; A47B 2220/0052; A47B 2220/008; A47B 2230/0092; A47B 2200/12; A01G 9/12; A01G 17/06; A47F 5/103

See application file for complete search history.

(56) References Cited

U.S. PATENT DOCUMENTS 3,489,385 A * 1/1970 Dill, Jr. ..... A47K 10/185 211/104
3,532,224 A * 10/1970 Grubb ..... A47F 5/13 211/118
3,998,332 A * 12/1976 Lambertson ..... A47F 5/0838 211/71.01

(Continued)

*Primary Examiner* — Ko H Chan
(74) *Attorney, Agent, or Firm* — Moser Taboada

(57) ABSTRACT

An outdoor lattice system comprises at least two posts and a plurality of modular lattice systems configured to be disposed between and supported by the at least two posts. The posts have an elongate body comprising multiple support openings arranged along the elongate body. Each of the modular lattice sections comprise a body, a first edge and a second edge, each edge being a longitudinal edge of the body, the second edge opposite to the first edge, each of the first edge and the second edge comprising a support element extending outwardly therefrom. The support element is configured to couple mechanically with a support opening from the plurality of support openings of the first post, and the at least one support element on the second edge of the first modular lattice section configured to couple mechanically with a support opening from the plurality of support openings of the second post.

9 Claims, 4 Drawing Sheets

(56) References Cited

U.S. PATENT DOCUMENTS

| | | | | | |
|---|---|---|---|---|---|
| 4,301,618 | A * | 11/1981 | August | A01G 17/06 | 47/46 |
| 4,333,287 | A * | 6/1982 | Lewis | B44F 3/00 | 52/311.3 |
| 4,494,661 | A * | 1/1985 | Krusche | A47B 96/061 | 211/87.01 |
| 4,499,688 | A * | 2/1985 | Droll | A47G 7/044 | 47/67 |
| 5,314,081 | A * | 5/1994 | Carroll | A47B 87/005 | 211/11 |
| 5,418,021 | A * | 5/1995 | Kim | B44F 1/063 | 428/14 |
| 5,647,166 | A * | 7/1997 | Neff | A01G 9/12 | 256/32 |
| 5,884,784 | A * | 3/1999 | Betts, Sr. | B01L 9/00 | 206/278 |
| 7,448,634 | B1 * | 11/2008 | Raub | A47F 5/083 | 108/108 |
| 9,737,141 | B2 * | 8/2017 | Johnson | A47B 55/02 | |
| 9,795,849 | B2 * | 10/2017 | Nelson | A63B 69/00 | |

* cited by examiner

OUTDOOR LATTICE SYSTEM

CROSS-REFERENCE TO RELATED APPLICATIONS

This application claims the benefit of U.S. Provisional Application Ser. No. 62/578,584, titled "OUTDOOR LATTICE SYSTEM," filed on Oct. 30, 2017, which is hereby incorporated by reference in its entirety.

FIELD

Embodiments of the present invention generally relate to outdoor lattice systems, and specifically to modular outdoor lattice systems.

BACKGROUND

Lattice systems are used in a variety of applications such as, for example, fencing, outdoor privacy walls, trellises, among several other applications. Typical lattice systems require professional installation using specialized tools, using which may be complicated and/or cumbersome for an average person. Further, conventional lattice systems are usually made of plastic, which is not eco-friendly, or of wood, which may degrade or show signs of wear due to weather.

Accordingly, there exists a need for an improved lattice system.

SUMMARY

Embodiments of outdoor lattice systems are provided herein. In some embodiments, an outdoor lattice system includes two or more posts, and a plurality of modular lattice sections. Each of the posts includes one or more support openings, and each of the modular lattice sections includes one or more support elements, configured to be inserted into corresponding support openings. When inserted into the support openings, the support elements physically couple the modular lattice sections with the two or more posts, wherein the modular lattice sections are supported by and between consecutive ones of the two or more posts.

Other and further embodiments of the present invention are described below.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 1:
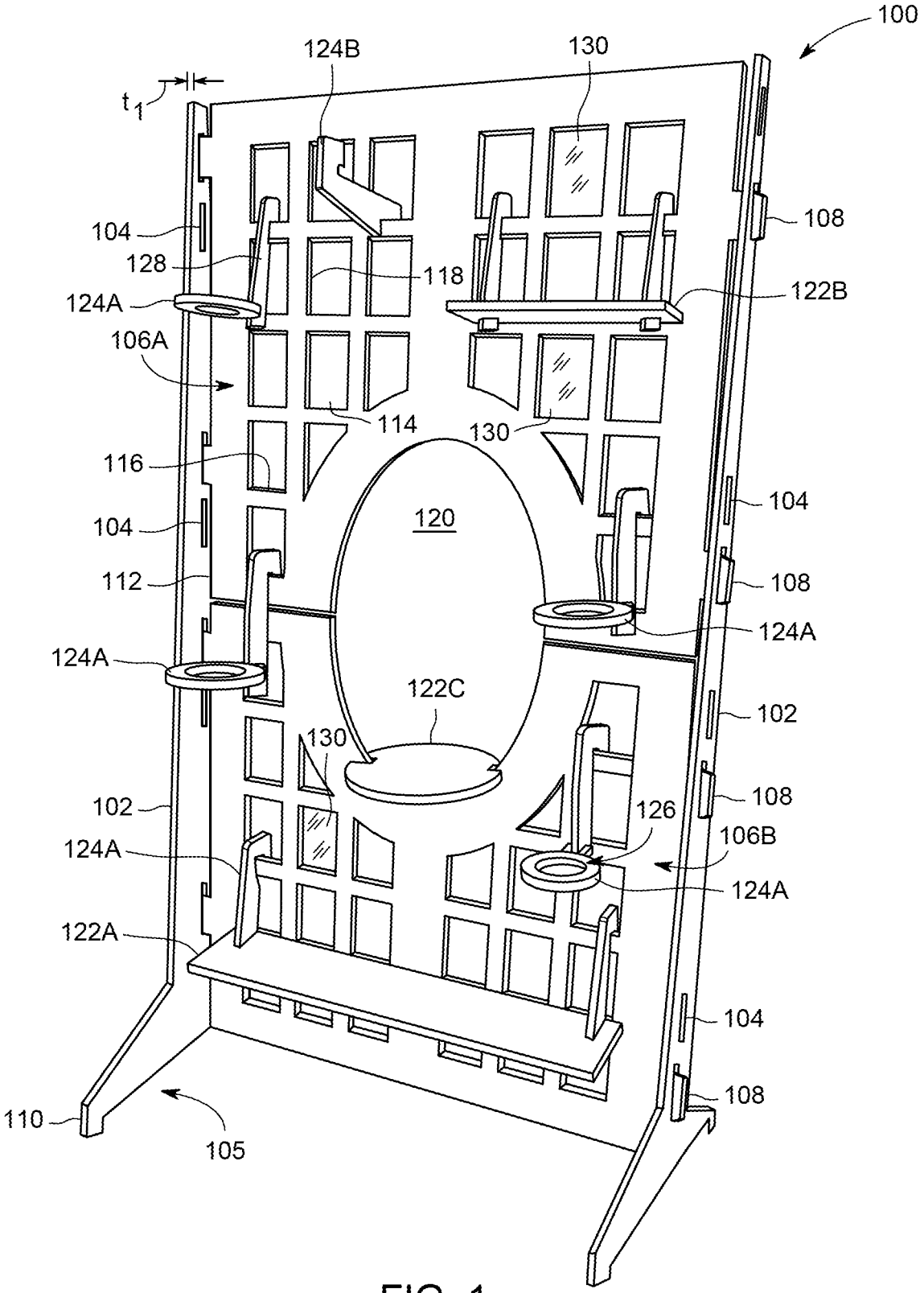
FIG. 1 illustrates an isometric view of an outdoor lattice system in accordance with some embodiments of the present invention.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Embodiments of outdoor lattice systems are described herein. The outdoor lattice systems are formed of an eco-friendly material that can withstand weather when placed outdoors and can advantageously be installed by hand without the need for any specialized tools, for example, by simple insertion and interference fits.

Figure 4:
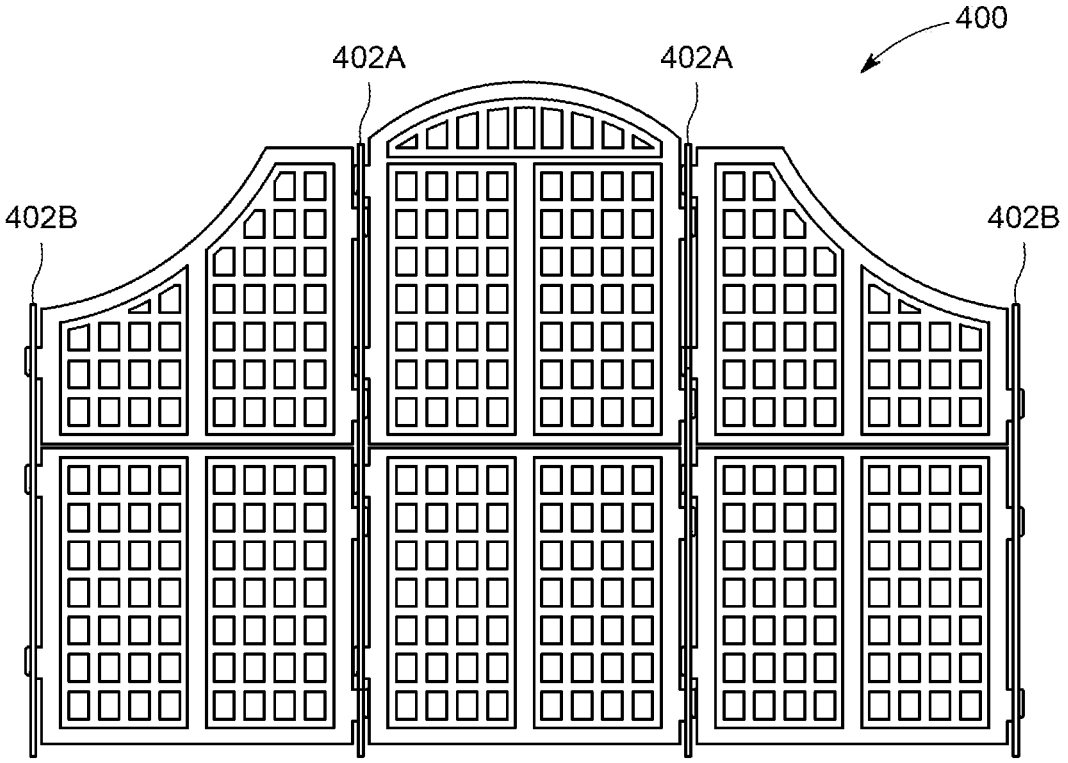
FIG. 4 illustrates a front view of an outdoor lattice system in accordance with some embodiments of the present invention.

FIG. 1 illustrates an isometric view of a lattice system 100 in accordance with some embodiments of the present invention. In some embodiments, the lattice system 100 includes two posts, each notated by reference numeral 102, and multiple modular lattice sections 106A, 106B (or together, 106) supported by and between the two posts 102. Each of the posts 102 have an elongate body having multiple openings 104, such as, for example, slots, holes, and the likes, formed in the post 102. The post 102 comprises a lower portion 105, and is configured to stand vertically upright when assembled with the modular lattice sections 106, with the support openings 104 arranged longitudinally along the post 102. The modular lattice sections 106A, 106B comprise one or more support elements 108 extending therefrom. The one or more support elements 108 of the modular lattice sections 106A, 106B are configured to be inserted into corresponding openings 104 of the posts 102, thereby physically coupling the modular lattice sections 106A, 106B and the posts 102. In some embodiments, the modular lattice sections 106A, 106B may be replaced with other modular lattice sections having support elements similar to the one or more support elements 108. In some embodiments, additional modular lattices may be supported between a third post and one of the two posts 102, for example, as shown in FIG. 4.

In some embodiments, the lattice system 100 is formed of a material comprising an exterior medium density fiberboard such as, for example, EXTIRA®. In some embodiments, the lattice system 100 is formed of a material comprising one or more of the exterior medium density fiberboard, an eco-friendly exterior-rated sheet material, polyvinyl chloride (PVC), or high density polyethylene (HDPE). In some embodiments, each element of the lattice system 100 is formed of a single sheet of medium density fiberboard material, advantageously improving the structural integrity of each element.

As illustrated in FIG. 1, in some embodiments, each of the modular lattice sections 106A, 106B includes a body 112 having a plurality of grid openings 114 disposed within the body 112 and arranged in a grid-like fashion. In such embodiments, the plurality of openings 114 are separated by lateral portions 116 and longitudinal portions 118 of the body 112. The modular lattice sections 106 have two longitudinal edges on either sides of the body, and one or more support elements 108 protrude outwardly from the edge of body 112. Although the plurality of openings 114 are illustrated as rectangular openings arranged in a grid-like fashion, the plurality of openings may alternatively have any shape (e.g., circular, triangular, among other decorative shapes), and the grid openings 114 may be arranged in any manner within the body 112 of the modular lattice sections 106. In some embodiments, a plurality of glass or other plastic based transparent panes 130 may be disposed in one or more of the grid openings 114.

In some embodiments, the modular lattice sections 106A, 106B may be identical in shape, or may have different shapes, however, the modular lattice sections 106A, 106B have the same width such that the one or more supporting elements from both the modular lattice sections 106A, 106B couple physically with the corresponding support openings 104 of the posts 102. In some embodiments, the modular lattice section 106A is configured to define a decorative opening 120 with the adjacent modular lattice section 106B. For example, in the embodiment depicted in FIG. 1, the decorative opening 120 is an oval disposed between the two modular lattice sections 106A, 106B.

Figure 2A:
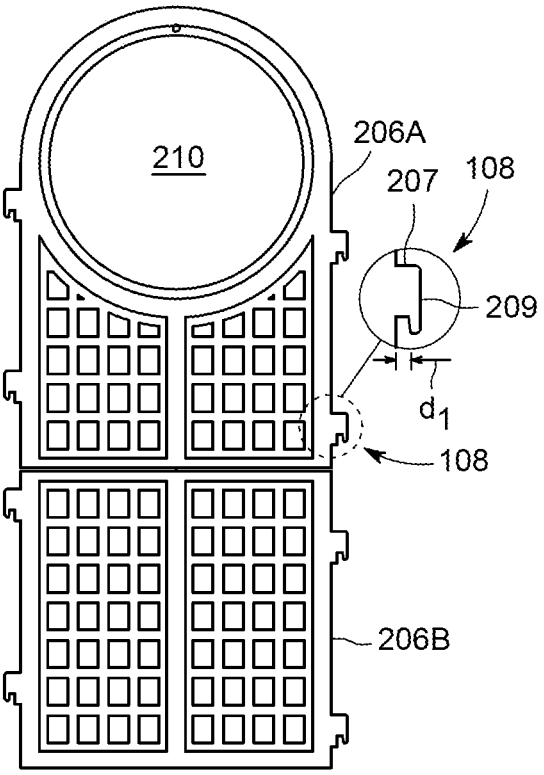
FIGS. 2A-D illustrate front views of modular lattice sections usable in the outdoor lattice system of FIG. 1, in accordance with some embodiments of the present invention.
Figure 2B:
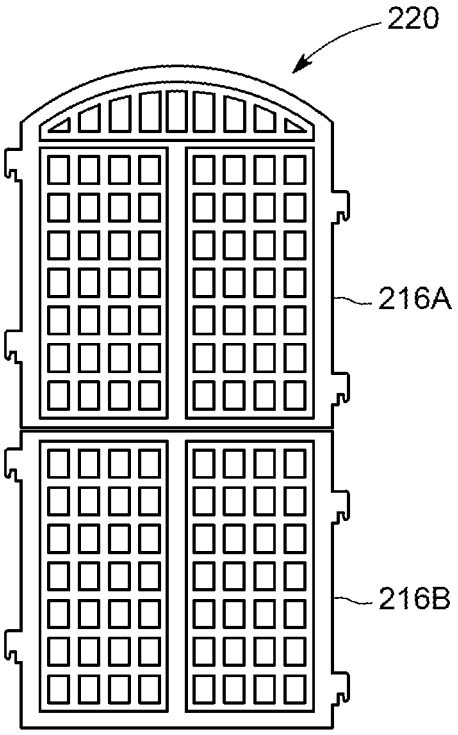

For example, FIGS. 2A-2D illustrate front views of different configurations of two modular lattice sections arranged adjacent to each other, and configured to be supported by and between two posts, for example, the posts 102 of FIG. 1. The different configurations of the modular lattice sections shown in FIGS. 2A-2B are interchangeable with the modular lattice sections 106A, 106B in the lattice system 100 of FIG. 1. In the embodiments of FIG. 2A, the modular lattice sections includes a first lattice section 206A having a circular decorative opening 210 disposed in an upper portion, and a rectangular second lattice section 206B disposed beneath the first lattice section 206A.

Figure 2C:
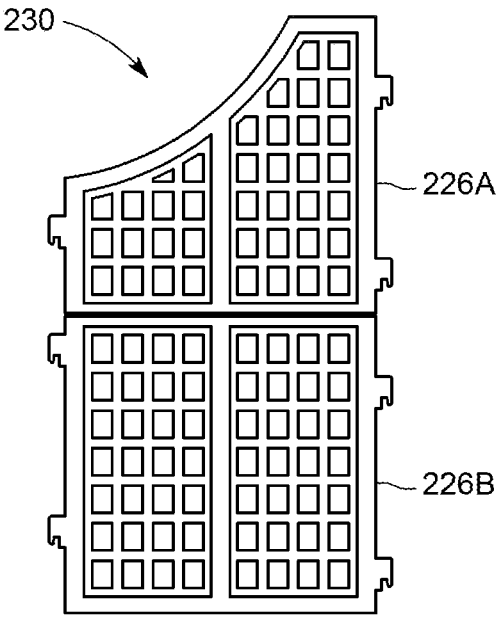
Figure 2D:
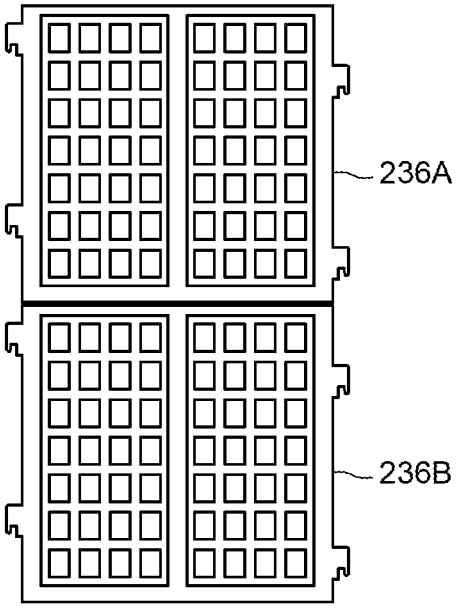

In the embodiment depicted in FIG. 2B, the modular lattice sections include a first lattice section 216A and a second lattice section 216B. The first lattice section 216A includes an arch-shaped section 220 disposed at an uppermost portion of the first lattice section 216A. In the embodiment depicted in FIG. 2C, the modular lattice sections include a first lattice section 226A and a second lattice section 226B. The first lattice section 226A includes a quadrant section 230. While each of FIGS. 2A-C depict three specific corresponding configurations of exemplary modular lattice sections, numerous different configurations of modular lattice sections may be formed by a combination of the configurations of FIGS. 2A-2C or of other shapes, and various such configurations of the modular lattice sections are contemplated herein. In some embodiments, such as the one depicted in FIG. 2D, the lattice system includes a first lattice section 236A and a second lattice section 236D, both of which are rectangular and only include grid openings.

FIG. 2A also depicts the detail of the support element 108 as shown in the enlarged circular portion, in accordance with some embodiments of the present invention. As illustrated in FIG. 2A, in some embodiments, each of the one or more support elements 108 includes a protruding arm 207 extending outwardly from the body and a locking arm 209 extending downwardly from an end of the protruding arm 207 opposite the body. The locking arm 209 has a dimension smaller than the support opening 104, such that the support element 108 can be extended through the support opening 104. In some embodiments, a lateral distance $d_1$ between the locking arm 209 and the body of the lattice section is slightly less than a thickness $t_1$ of the post 102 to create a snug interference fit between the support element 108 and the post 102. When the support element 108 from a modular lattice section is extended through the support opening 104 of a post, the edge of the support opening 104 inserts into the support element 108 forming an interference fit, which achieves a structurally robust coupling between the modular lattice sections and the posts of the lattice system 100.

Returning to FIG. 1, in some embodiments, the lattice system 100 includes one or more shelves 122*a*, 122*b*, 122*c* configured to be coupled to portions of the body 112. For example, the first shelf 122*a* has a rectangular shape, and spans approximately the entire width of the modular lattice section 106B. The second shelf 122*b* has a rectangular shape, and spans about half the width of the modular lattice section 106A. The third shelf 122*c* has a circular shape and is disposed within the decorative opening 120. In some embodiments, the lattice system 100 may additionally or alternatively include one or more decoration support elements 124A, 124B. The decoration support elements 124A, 124B (together, 124) are configured to support decorations (not shown) structurally on the lattice system 100. For example, a first decoration support element 124A may include a hole 126 into which a pot may be inserted. A second decoration support element 124B may have a hook-like structure so that rope or a similar linear decorative element, for example, string lights, a hanging pot, among others, may be hung therefrom. The one or more shelves 122*a*, 122*b*, 122*c* and the one or more decoration support elements 124A, 124B are merely examples of structures that can be attached removably to the lattice system 100 to support decorative elements.

As depicted in FIG. 1, in some embodiments, the one or more shelves 122*a*, 122*b*, 122*c* and the one or more decoration support elements 124A, 124B are removably coupled to the body 112 via coupling elements 128. Each coupling element 128 includes an opening forming a slot having a width $d_1$, to receive one of the lateral portions 116, having a thickness $t_1$ of the body 112. The thickness $t_1$ of the lateral portion 116 is slightly greater than and the width $d_1$ of the slot in the coupling element 128, such that snug interference fit exists between the slot of the coupling element 128 and the lateral portions 116. Such an interference fit provides the structural integrity and robustness to the connecting elements 128, and thereby, to the one or more shelves 122*a*, 122*b*, 122*c*, and/or the one or more decoration support elements 124A, 124B attached to the coupling element 128. In some embodiments, the one or more shelves 122*a*, 122*b*, 122*c*, and/or the one or more decoration support elements 124A, 124B have a dimension having the thickness $t_1$, and the coupling element 128 has another slot having a width $d_1$ to receive the one or more shelves 122*a*, 122*b*, 122*c* and/or the one or more decoration support elements 124A, 124B via a similar interference fit.

Figure 3:
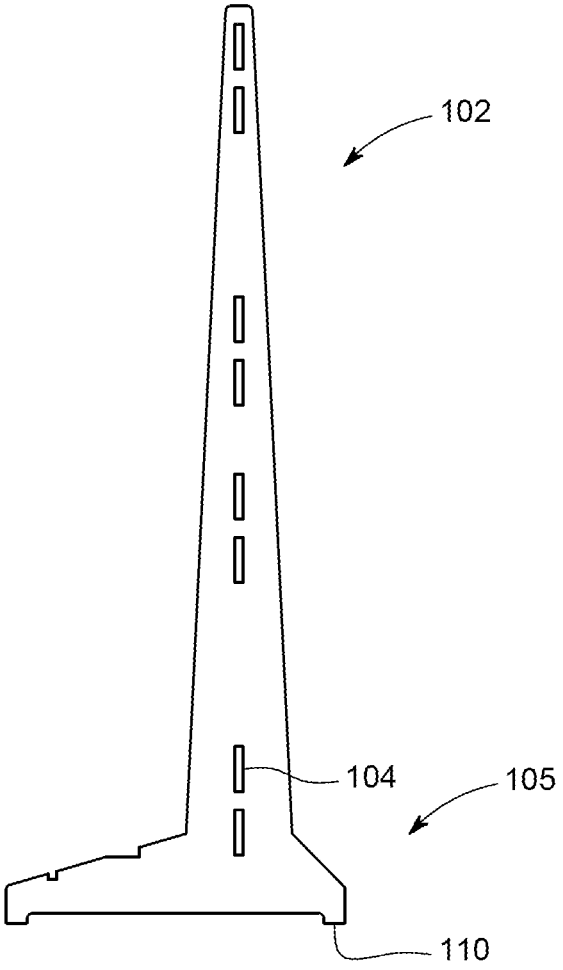
FIG. 3 illustrates a side view of a post for use with the outdoor lattice system of FIG. 1, in accordance with some embodiments of the present invention.

FIG. 3 illustrates a side view of the post 102 in accordance with some embodiments of the present invention. In some embodiments, each of the two or more posts 102 includes a lower portion 105 having two legs 110 extending downwardly from the lower portion 105. Various support openings 104 may be formed in the posts to receive the support the support elements 108 of the modular lattice sections as desired. In some embodiments, an outdoor lattice system may include more than two posts 102, and a corresponding number of modular lattice sections. For example, FIG. 4 illustrates a front view of an outdoor lattice system 400 comprising four posts $\mathbf{402}_A$, $\mathbf{402}_B$ (together, 402), each having a lower portion, legs extending therefrom, and support openings. In the illustration of FIG. 4, the posts $\mathbf{402}_A$ are taller than the posts $\mathbf{402}_B$. Different configuration of modular lattice sections may be supported between the posts. For example, the modular lattice section configuration between the posts $402_A$-$402_A$ are different from the modular lattice section configuration between the posts $402_A$-$402_B$.

Figure 5:
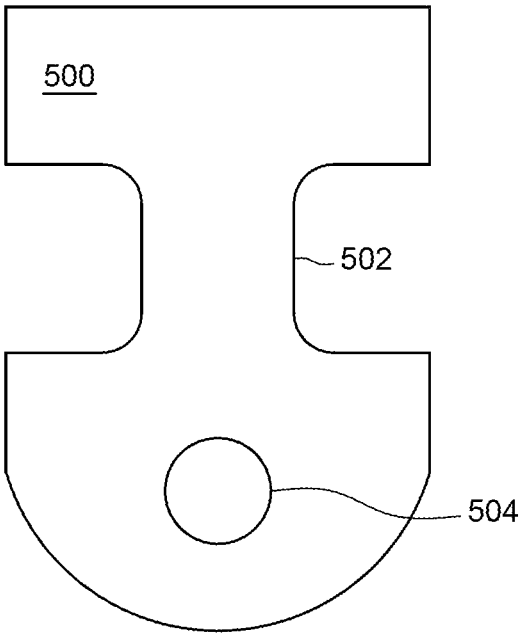
FIG. 5 illustrates a top view of a key lock for use with the outdoor lattice system in accordance with some embodiments of the present invention.

FIG. 5 illustrates a top view of a key lock 500 for use with the outdoor lattice system (100 or 400) in accordance with some embodiments of the present invention. The key lock 500 comprises two symmetrical slots 502 proximal to a first end and receiver 504 proximal to second end opposite the first end. The symmetrical slots are configured to form an interface fit, for example, with one of the support openings 104 of the post 102. The key lock 500 is inserted into the support opening 104 from the first end side, and turned by 90 degrees such that the slots 502 of the key lock 500 interface with the edges of the support opening 104 forming an interference fit therebetween. The receiver 504 projects outwardly from the post 102 and is configured to receive a stake or a spike in a vertical orientation. When a stake or a spike is inserted through the receiver 504 into the ground, the key lock 500 is rendered immovable in a horizontal direction, and thereby, the post 102 is rendered immovable in the horizontal direction. In this manner, the key lock 500 imparts additional stability to the post 102, and thereby the lattice system.

The lattice system described herein comprises modular components, and can be assembled by hand via interference fits, without requiring any specialized tools or skills. Because the inventive lattice system is modular, the system can include any number of modular lattice sections and posts to assembly a lattice system having any desired length and any desired decorative configuration. The lattice system may further advantageously be used as a privacy panel, railing system, fencing system, or for other outdoor uses, such as a garden trellis. In some embodiments, the lattice system is formed of a single sheet of material, thus provided improved structural integrity.

While the foregoing is directed to embodiments of the present invention, other and further embodiments of the invention may be devised without departing from the basic scope thereof.

The invention claimed is:

1. A lattice system, comprising:

at least two posts, wherein each of the at least two posts have an elongate body comprising a plurality of support openings arranged longitudinally along the elongate body, the at least two posts comprising a first post and a second post; and a plurality of modular lattice sections comprising a first modular lattice section and second modular lattice section, wherein each of the first and the second modular lattice sections comprises a body, a first edge and a second edge, each edge being a longitudinal edge of the body, the second edge opposite to the first edge, each of the first edge and the second edge comprising at least one support element extending outwardly therefrom, the at least one support element on the first edge of the first modular lattice section configured to couple mechanically with a support opening from the plurality of support openings of the first post, and the at least one support element on the second edge of the first modular lattice section configured to couple mechanically with a support opening from the plurality of support openings of the second post, wherein the plurality of modular lattice sections are configured to be supported by the at least two posts along the first edge and the second edge, wherein each of the at least two posts comprises a lower portion, and at least two legs extend downwardly from the lower portion, the lattice system further comprising a key lock, the key lock configured to engage with one of the support openings of one of the two posts, the key lock comprising a receptacle to receive a stake in a longitudinal direction, when the key lock is engaged with the one of the support openings of one of the two posts.

2. The lattice system of claim 1, wherein the at least one support element comprises a protruding arm extending horizontally from the corresponding edge, and a locking arm extending vertically downward from the protruding arm, the locking arm located at a distance $d_1$ from the corresponding edge, wherein the distance $d_1$ is smaller than the thickness of the support openings $t_1$, and wherein the locking arm is insertable into the corresponding support opening, and wherein the at least one support element forms an interference fit with the support opening.

3. The lattice system of claim 1, wherein the lattice system is formed of material comprising at least one of a medium density fiberboard, poly vinyl chloride (PVC), or high density polyethylene (HDPE).

4. The lattice system of claim 1, wherein each of the body of the first modular lattice section and the body of the second modular lattice section comprises a plurality of grid openings arranged in the body, wherein the plurality of grid openings are separated by lateral and longitudinal portions of the body.

5. The lattice system of claim 4, wherein one or more adjacent modular sections of the plurality of modular lattice sections are configured to define a decorative opening at an interface of the one or more adjacent modular lattice sections.

6. The lattice system of claim 4, further comprising a coupling element comprising a body comprising a slot extending therein from one of the edges of the body of the coupling element, the slot having a width $d_1$, wherein the lateral portion has a thickness $t_1$, wherein the distance $d_1$ is smaller than the thickness of the lateral section $t_1$, and wherein the lateral sections are insertable in the slot, and wherein the coupling element forms an interference fit with the lateral section.

7. The lattice system of claim 6, further comprising at least one shelf configured to be coupled to one or more portions of at least the body of the first modular lattice section or the body of the second modular lattice section, via one or more of the decoration support elements.

8. The lattice system of claim 4, further comprising a glass pane disposed in at least one grid opening of the plurality of grid openings.

9. The lattice system of claim 4, wherein the at least two posts further comprises a third post, wherein the plurality of modular lattice sections further comprise a third and a fourth modular lattice section, wherein the third and the fourth modular lattice sections are supported between the first post and the third post.

* * * * *